US009311862B2

(12) United States Patent
Morishita

(10) Patent No.: US 9,311,862 B2
(45) Date of Patent: Apr. 12, 2016

(54) BACKLIGHT APPARATUS, CONTROL METHOD THEREFOR, AND DISPLAY APPARATUS

(75) Inventor: Masashi Morishita, Urayasu (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 371 days.

(21) Appl. No.: 13/421,335

(22) Filed: Mar. 15, 2012

(65) Prior Publication Data

US 2012/0242564 A1 Sep. 27, 2012

(30) Foreign Application Priority Data

Mar. 22, 2011 (JP) ..... 2011-062650
Dec. 12, 2011 (JP) ..... 2011-271220

(51) Int. Cl.
*G09G 3/36* (2006.01)
*G09G 3/34* (2006.01)

(52) U.S. Cl.
CPC ..... *G09G 3/3413* (2013.01); *G09G 3/342* (2013.01); *G09G 2310/024* (2013.01); *G09G 2310/0237* (2013.01); *G09G 2320/0247* (2013.01); *G09G 2320/0666* (2013.01); *G09G 2330/021* (2013.01); *G09G 2354/00* (2013.01)

(58) Field of Classification Search
None
See application file for complete search history.

(56) References Cited

U.S. PATENT DOCUMENTS

2004/0264212 A1 12/2004 Chung et al.
2006/0007112 A1* 1/2006 Park ..... G09G 3/3413 345/102
2006/0170645 A1 8/2006 Fisekovic et al.
2007/0103934 A1 5/2007 Keh et al.
2007/0211013 A1* 9/2007 Uehara ..... G09G 3/3413 345/102
2011/0018912 A1* 1/2011 Adachi ..... G09G 3/3413 345/690

FOREIGN PATENT DOCUMENTS

CN 1716039 A 1/2006
CN 101965477 A 2/2011

(Continued)

OTHER PUBLICATIONS

Jan. 17, 2014 Chinese Office Action Action, that issued in Chinese Patent Application No. 201210084190.0.

(Continued)

*Primary Examiner* — Joseph Haley
*Assistant Examiner* — Ifedayo Iluyomade
(74) *Attorney, Agent, or Firm* — Cowan, Liebowitz & Latman, P.C.

(57) ABSTRACT

A light source unit that uses white light LEDs in a backlight apparatus is provided with a plurality of white light LEDs that can individually provide white light illumination. Each of the white light LED units respectively corresponds to partition areas in the vertical direction of the screen and is illuminated by scanning in sequence in conformity to the display screen of an LCD display unit. LED units that carry out white light display by RGB color mixing are continuously illuminated. In addition, in another embodiment, white light LEDs are continuously illuminated in a low power consumption mode, and ELD units that carry out white light display by RGB color mixing are illuminated by scanning in sequence in conformity to the display screen of the LCD display device.

16 Claims, 5 Drawing Sheets

(56) References Cited

FOREIGN PATENT DOCUMENTS

| | | | |
|---|---|---|---|
| JP | 2000-321551 | | 11/2000 |
| JP | 2006-520926 | A | 9/2006 |
| JP | 2007-133407 | | 5/2007 |
| JP | 2007-133407 | A | 5/2007 |
| JP | 2008-145909 | | 6/2008 |
| JP | 2002-099250 | A | 4/2012 |
| WO | 2010-062647 | A | 6/2010 |
| WO | 2010/062647 | A2 | 6/2010 |

OTHER PUBLICATIONS

Jul. 11, 2012 European Search Report of the counterpart European Patent Application No. 12160845.9.

Jan. 29, 2013 Japanese Office Action, that issued in Japanese Patent Application No. 2011-271220.

Oct. 9, 2014 Chinese Office Action, that issued in Chinese Patent Application No. 201210084190.0.

* cited by examiner

BACKLIGHT APPARATUS, CONTROL METHOD THEREFOR, AND DISPLAY APPARATUS

BACKGROUND OF THE INVENTION

1. Field of the Invention

The present invention relates to an illumination control technology for a backlight apparatus that uses light emitting elements that can display white light.

2. Description of the Related Art

In recent years, liquid crystal display (LDC) apparatuses have been developed as a display apparatus having a high definition, broad color gamut, and low power consumption. White light LEDs or LEDs that can display white light by mixing RGB colors and the like are used as light emitting diodes (below, abbreviated "LED") in a light source unit for a backlight apparatus. During video display on liquid crystal display apparatuses, blurring occurs in the video image. This is caused by the slowness in the response speed of the liquid crystal molecules that are used in a liquid crystal panel. Japanese Patent Laid-Open No. 2000-321551 proposes a method in which the power supply to the LEDs of a backlight apparatus is stopped for a period during which the liquid crystal panel is responding and a flickering scan is carried out. However, because a reduction in the screen brightness and flicker occur in this method, Japanese Patent Laid-Open No. 2008-145909 discloses a technology in which a black image or a grey image is inserted over the entire screen as an improved method.

In addition, Japanese Patent Laid-Open No. 2007-133407 discloses a backlight display that uses a white light source and an RGB light source. In order to realize high efficiency light emission with a broad color gamut, the RGB light source is used in a low brightness state, and when the required value of the brightness is increased, the white light source is added to the RGB light source.

Generally, in a light emitting element such as an LED, between a white light source that can individually provide white light illumination and a light source that can provide white light illumination by mixing RGB colors and the like, the white light source that can individually provide white light illumination has a broader color gamut. Thus, in the technology that has been disclosed in Japanese Patent Laid-Open No. 2007-133407, the color gamut changes due to the displayed brightness because the light sources that emit light in a low brightness state or a high brightness state are different.

SUMMARY OF THE INVENTION

A backlight apparatus of the present invention uses light emitting elements that can provide white light illumination, reduces the variation in the color gamut due to the displayed brightness and improves video viewing characteristics.

According to an aspect of the present invention, a backlight apparatus is provided that includes a first light source unit comprising light emitting elements that can provide white light illumination and a second light source unit comprising light emitting elements that can provide white light illumination having characteristics that differ from those of the light emitting elements of the first light source unit. In addition, the apparatus includes an illumination control unit that activates the first light source unit by scanning in sequence the light emitting elements of the first light source unit, the light emitting elements having been segmented into a plurality of partition areas, while continuously activating the second light source unit.

According to the present invention, a backlight apparatus uses light emitting elements that can provide white light illumination, reduces the variation in the color gamut due to displayed brightness and improves the video viewing characteristics.

Further features of the present invention will become apparent from the following description of exemplary embodiments with reference to the attached drawings.

DESCRIPTION OF THE EMBODIMENTS

In the following embodiments, an explanation will be provided for a backlight apparatus and a display apparatus that use white light LED elements as white light emitting elements and use LED element groups that can display white light by using RGB color mixing.

First Embodiment

Figure 1:
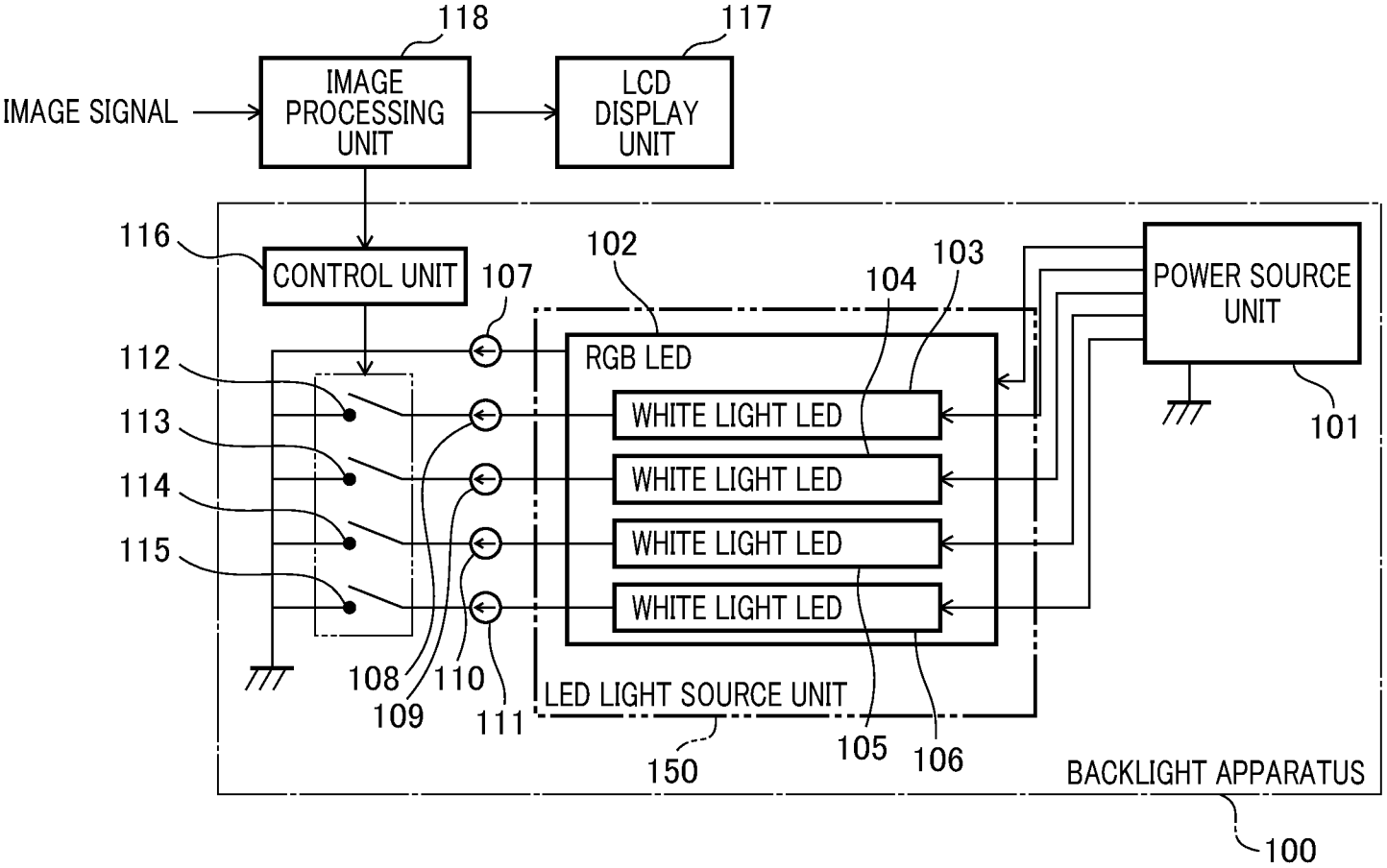
FIG. 1 is a block diagram that shows an example of the configuration of a backlight apparatus 100 in order to explain, along with FIGS. 2A, 2B, and 3, a first embodiment of the present invention.

FIG. 1 is a block diagram that shows an example of a configuration of a backlight apparatus 100 according to a first embodiment of the present invention. In the backlight apparatus 100, the power source unit 101 supplies a power source voltage to each of the LEDs that is disposed in the LED light source unit 150. The LED light source unit 150 is an LED array substrate used in a backlight source. In this example, the first light source unit is provided with a plurality of white light LED light sources (white light LED units 103 to 106) that can individually provide white light illumination. In addition, the second light source unit is provided with an LED light source (below, referred to as the "RGB LED unit") 102 that obtains white light by mixing RGB primary color light. That is, the first light source unit comprising light emitting elements that can provide white light illumination and the second light source unit comprising light emitting elements having properties that differ from those of the light emitting elements of the first light source unit and that can provide white light illumination. In FIG. 1, the first light source unit and the second light source unit are shown in a superimposed state.

Figure 2A:
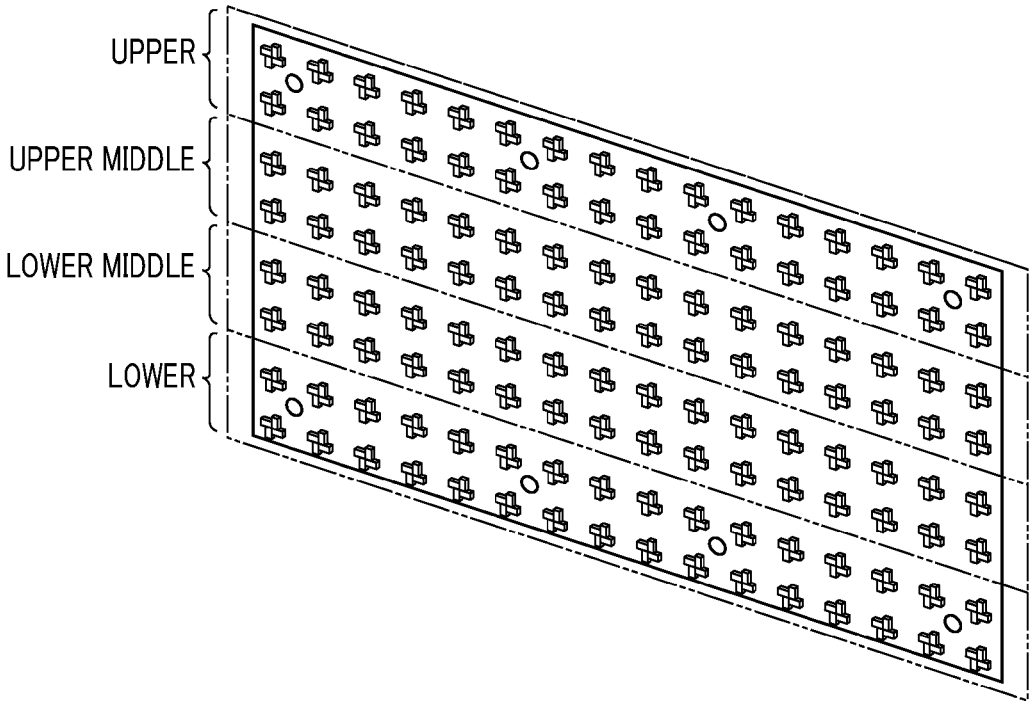
FIG. 2A is a perspective view of the LED light source unit 150 that is shown in FIG. 1.

The RGB LED unit 102 is formed by a plurality of LEDs that each emit each of the RGB colors and emits white light over the entirety of the backlight by mixing colors. The first light source unit is formed by white light LED units 103 to 106, which use white light LEDs, and as shown in FIGS. 2A and B, these emit light in partition areas that are produced by segmenting the backlight source into four areas in the longitudinal direction of the backlight source. Specifically, the white light LED units 103 to 106 respectively correspond to the upper portion, the upper middle portion, the lower middle portion, and the lower portion of the partition areas, which have been segmented from the top to the bottom of the screen, and illumination control is carried out in sequence as described below. The electric current sources 107 to 111 drive each of the LEDs by a constant electric power. The electric current source 107 is connected to the RGB LED unit 102, and the electric current sources 108 to 111 are respectively connected to the white light LED units 103 to 106. In addition, the electric current sources 108 to 111 are respectively grounded via the switching elements 112 to 115, and the electric current source 107 grounded without passing through a switching element.

The control unit 116 that functions as an illumination control unit carries out timing control by which the LEDs of the backlight sources are caused to emit light according to a timing signal that is output by an image processing unit 118, and illuminates the white light LEDs 103 to 106 by turning ON the switching elements 112 to 115. The LCD display unit 117 is a liquid crystal display device that carries out the image display of graphics, characters, and images and the like according to image signals that are output by an image processing unit 118. By carrying out the switching control on the LED light source units that form the backlight apparatus, an illuminated state and an extinguished state can be realized.

FIG. 2A is a perspective view that shows an example of the configuration of the LED light source unit 150 that is shown in FIG. 1.

The LED light source unit 150 is a type of array substrate where LEDs are disposed on the backside of the display and arranged in parallel with respect to the direction of scanning line. Element groups, in which four LEDs form one group, are disposed in height and width on the substrate. Four LEDs, for example, a white light LED, a red light LED, a blue light LED, and a green light LED, are arranged as one group. The white light LEDs provided in each of the partition areas are each formed by the white light LED units 103 to 106 shown in FIG. 1. In addition, red light LEDs, blue light LEDs, and green light LEDs can provide white light illumination by color mixing, and these form the RGB LED unit 102 shown in FIG. 1. Generally, when using RGB LEDs to carry out white light illumination by color mixing, the light emission efficiency is low in comparison to white light illumination using white light LEDs, but a broad color gamut display is possible.

In the present embodiment, light emission control of the white light LED units 103 to 106 is carried out by partitioning the entire screen into four areas in a vertical direction. However, the partition positions and the number of LEDs differ according to the size and performance of the display area. In addition, even if the configuration is not one in which four LEDs, consisting of the three RGB primary colors and white light, are arrayed as one group, if the whole screen can be illuminated by LEDs that can provide white light illuminated by color mixing and each of the white light LED units can be independently driven, any arrangement may be used. In this case, each of the LEDs that form the RGB LED unit 102 can be identically controlled over the entire screen.

Figure 2B:
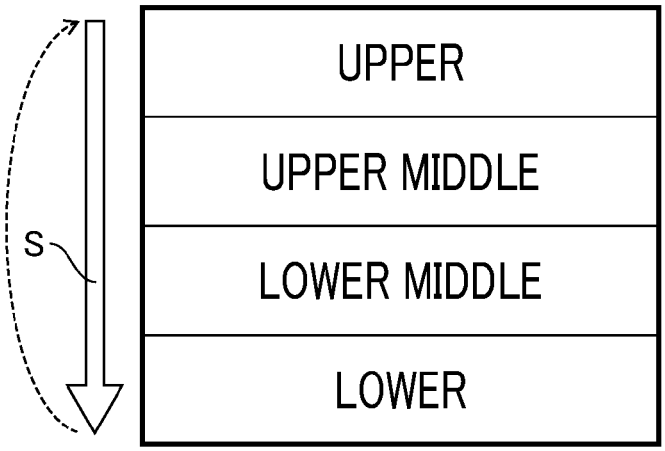
FIG. 2B is an explanatory diagram that shows the illumination sequence of the white light color LED units.

FIG. 2B shows the sequence in which illumination control is performed on white light LED units arrayed in the LED light source unit 150.

The LCD display unit 117 is line-sequentially driven, and the display response is completed in a sequence starting from the top portion of the screen. For example, the white light LED unit 103 is a light source unit corresponding to the upper area of the screen, the white light LED unit 104 is a light source unit corresponding to the upper middle area, the white light LED unit 105 is a light source unit corresponding to the lower middle area, and the white light LED unit 106 is a light source unit corresponding to the lower area. As shown by the arrow S, illumination control is carried out on the LED unit that is partitioned into four areas in a sequence from the upper area, to the upper middle area, to the lower middle area, and to the lower area of the screen in conformity to the display screen of the LCD display unit 117. As shown by the broken arrow, when the illumination of the lower area has finished, illumination control returns again to the upper area and the illumination cycle is repeated.

Figure 3:
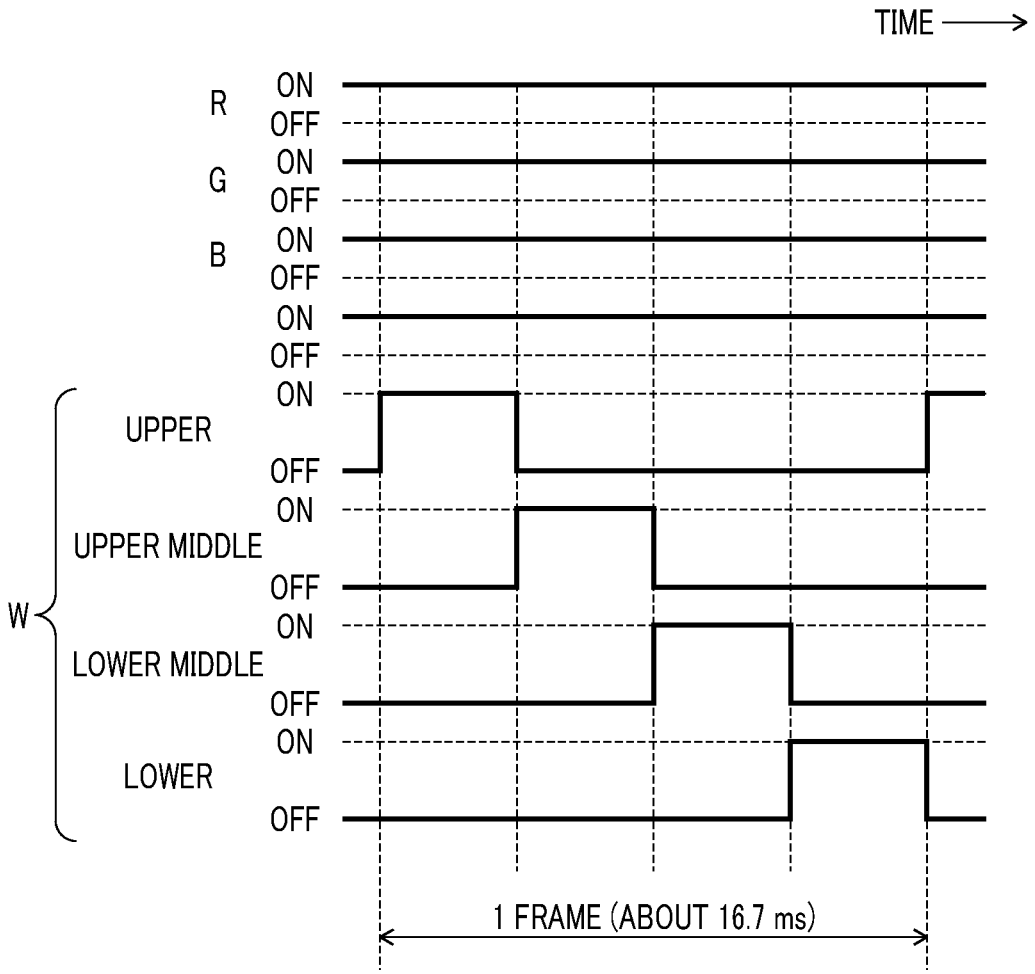
FIG. 3 is a diagram that illustrates the illumination timing of each LED unit.

FIG. 3 is a diagram that illustrates the illumination timing of the LED units. "R", "G", "B" show the illumination state of each of the LEDs that form the RGB LED unit 102. The upper, upper middle, lower middle, and lower shown next to "W" show the illumination state of the white light LEDs respectively corresponding to the upper area, the upper middle area, the lower middle area, and the lower area of the screen. "ON" represents the illuminated state of an LED, and "OFF" represents the extinguished state of an LED. In the case in which a 60 frame image is displayed for 1 second, the time during which an image for one frame can be displayed corresponds to a time of about 16.7 ms (milliseconds).

The RGB LED unit 102 is in a continuously illuminated state, and the white light LED units 103 to 106 are scan illuminated in sequence. Specifically, after the writing of the image signal, the operation of illuminating only the white light LEDs for each partition display area is executed in sequence within a one-frame period. In each frame, first, the white light LED unit 103 is illuminated, and at the point in time it is extinguished, the next white light LED unit 104 is illuminated. Subsequently, at the point in time that the white light LED unit 104 is extinguished, the next white light LED unit 105 is illuminated. After the white light LED unit 105 is extinguished and the white light LED unit 106 is illuminated at the end of the frame, the LED unit is extinguished at the end of the frame period, and the operation moves to the next frame.

The RBG LED unit 102 is continuously illuminated at an amount of light equivalent to 100 cd/m$^2$. In addition, when the white light LED units 103 to 106 are illuminated, the total amount of light emitted including that of the LED unit 102 is 200 cd/m$^2$. The scan illumination is repeatedly executed using the pattern that is shown in FIG. 3, and a brightness difference is produced between the portion at which white light illumination is carried out by color mixing by the RGB LED unit 102 and the white light LED units that are illuminated in sequence. Because the portion having the high brightness of 200 cd/m$^2$ is scan illuminated using the pattern that is shown in FIG. 3, to an observer, the portion having a low brightness of 100 cd/m$^2$ appears relatively gray. That is, because the portion having the low brightness appears gray, the contrast difference between this portion and the portion having a high brightness becomes small, and flicker becomes unnoticeable.

In the first embodiment, a display having a broad color gamut is possible because the RGB LED unit 102, which produces white light by color mixing, is caused to emit light to the entire backlight apparatus and the white light LED units 103 to 106 are caused to emit light by being scanned in sequence in the vertical direction of the screen at the partition areas. In addition, the effects that the flicker becomes unnoticeable and video viewing characteristics of the display apparatus are improved are obtained.

In the present embodiment, an explanation was provided for the case in which white light LED elements are used as white light emitting elements, and at the same time, LED element groups are used that can display white light by using RGB color mixing, but this is not limiting. For example, a configuration may be used in which two or more types of light emitting element groups that can provide white light display by RGB color mixing are used, where the properties of the color gamut and power consumption and the like for the white light emission in the case of color mixing differ. In addition, a configuration may be used in which two or more types of white light emitting elements are used that can provide white light illumination individually, where the properties of the color gamut and power consumption during white light emission differ. That is, the present invention can also be applied to the case in which a configuration is used for which the color gamut and power consumption and the like during white light emission differ due to using light emitting elements (groups) that are continuously illuminated and light emitting elements (groups) that are scan illuminated.

Second Embodiment

Next, a second embodiment of the present invention will be explained. In the second embodiment, it is possible to select a first control mode (below, referred to as the "broad color gamut mode") using the first embodiment and a second control mode (below, referred to as the "low power consumption mode") that suppresses power consumption.

Figure 4:
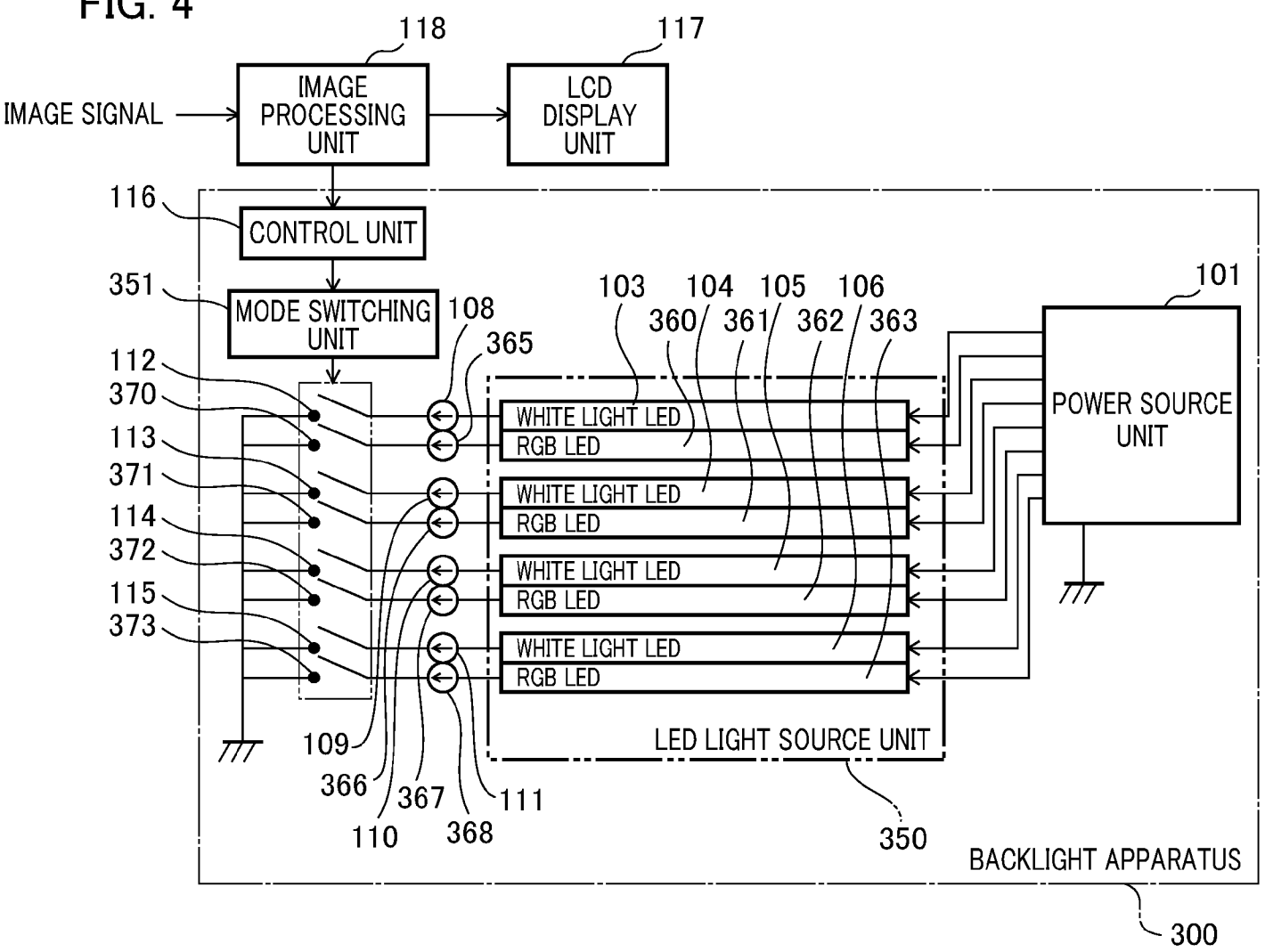
FIG. 4 is a block diagram that shows an example of the configuration of the backlight apparatus 300 in order to explain, along with FIG. 5, a second embodiment of the present invention.

FIG. 4 is a block diagram that shows an example of the configuration of a backlight apparatus 300 according to the second embodiment. The difference between the second embodiment and the first embodiment is that the illumination control of LEDs disposed in the LED light source unit 350 can be switched by the mode switching unit 351. Thus, below, the point of difference between the first and second embodiments will be explained, and the explanations of identical parts will be omitted by using the reference numerals that have already been used for them.

In the present example, four LED units, 360 to 363, are provided, and these respectively are grouped with the white light LED units 103 to 106. For example, the RGB LED unit 360 and white light LED unit 103 correspond to the upper area of the screen and the RGB LED unit 361 and the white light LED unit 104 correspond to the upper middle area of the screen. In addition, the RGB LED unit 362 and the white light LED unit 105 correspond to the lower middle area of the screen, and the RGB LED unit 363 and the white light LED unit 106 correspond to the lower area of the screen.

The electric current sources 108 to 111 that drive the white light LED units 103 to 106 with a constant power are respectively grounded via switching elements 112 to 115. In addition, the electric current sources 365 to 368 that drive the RGB LED units 360 to 363 by a constant power are respectively grounded via the switching elements 370 to 373.

Depending on the illumination control mode that has been selected by the mode switching unit 351, the control unit 116 controls the timing at which the LEDs, which are the backlight sources, are caused to emit light according to a timing signal that is output by an image processing unit 118. Thereby, the white light LED units 103 to 106 are respectively illuminated by the ON control of the switching elements 112 to 115, and the RGB LED units 360 to 363 are respectively illuminated by the ON control of the switching elements 370 to 373.

The illumination control method for the LEDs that are disposed in the LED light source unit 350 is identical to the case of the first embodiment, but differs on the point that either of the white light LED units or the RGB LED units can be scan illuminated.

In the present embodiment, the following illumination control can be selected by the mode switching unit 351:

The RGB LED unit is continuously illuminated and the white light LED unit is scan illuminated (during broad color gamut mode)

The white light LED unit is continuously illuminated and the RGB LED unit is scan illuminated (during low power consumption mode)

For example, the mode switching unit 351 can select the illumination control mode according to the mode that has been selected by a user. In addition, the mode switching unit 351 may select the illumination control mode depending on the image that is displayed by the LCD display unit 117. In this case, the control unit 116 obtains information related to the image that is displayed on the LCD display unit 117 from the image processing unit 118, and transmits this information to the mode switching unit 351. For example, the control unit 116 can obtain color gamut information and pixel number information for the image from metadata and the like that is appended to the image. In addition, the mode switching unit 351 selects an illumination control mode depending on the information that has been obtained. For example, the broad color gamut mode is selected in the case in which the color gamut of the image that is displayed on the LCD display unit 117 is comparatively broader than a predetermined range, for example, in the case of an Adobe RGB (trademark) color gamut or a DCI (Digital Cinema Initiatives) rated color gamut. In addition, the low power consumption mode may be selected in the case in which the color gamut of the displayed image is comparatively narrow, for example, in the case of an sRGB color gamut. In addition, the mode switching unit 351 selects the broad color gamut mode in the case in which the pixel number of the image is comparatively larger than a predetermined value (threshold value) (for example, 1920×1080 pixels and the like). In the case in which the pixel number of the image is comparatively smaller than a predetermined value (for example, 640×480 pixels and the like), the low power consumption mode may be selected. Note that the predetermined ranges and predetermined values described above can be arbitrarily selected.

Figure 5:
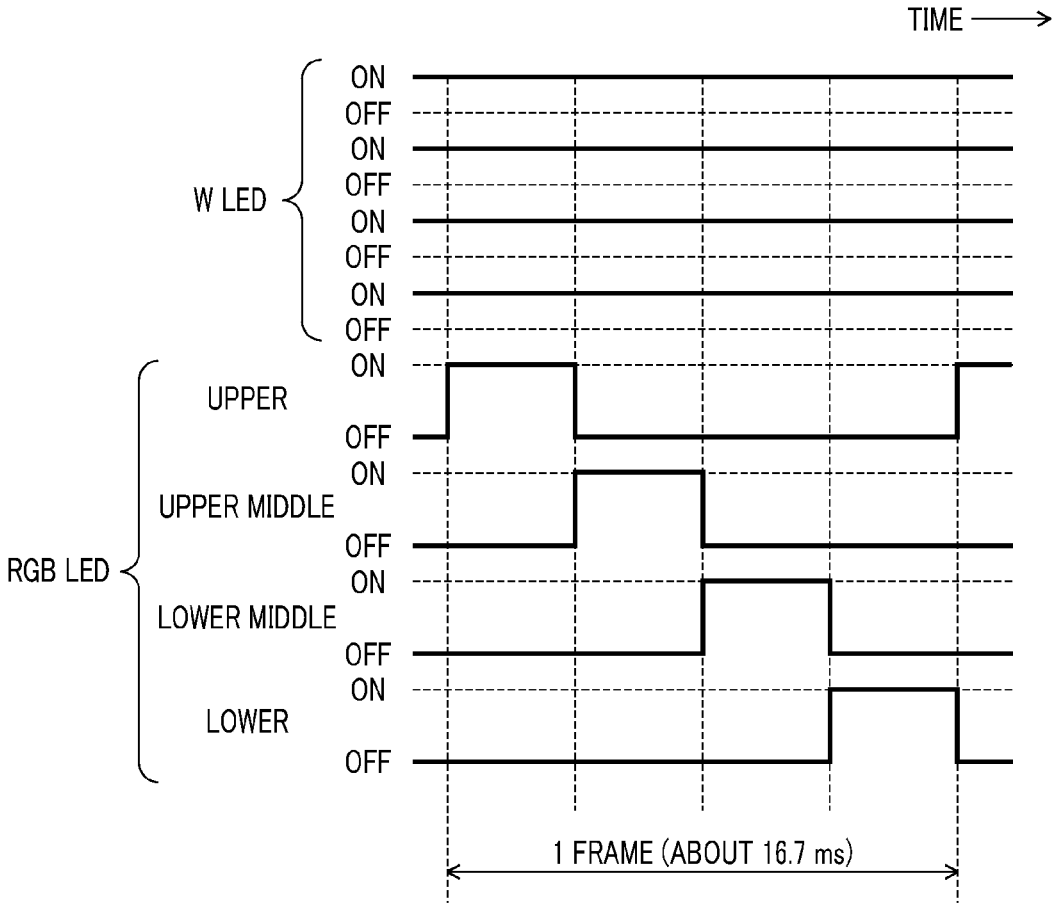
FIG. 5 is a diagram that illustrates the illumination timing of each LED unit.

FIG. 5 shows the illumination timing of the LED units in the case in which control is carried out in the low power consumption mode. "W LED" in the figure indicates the illumination state of the white light LED units 103 to 106, and these respectively correspond to the light source units of the upper area, the upper middle area, the lower middle area, and the lower area of the screen. The white light LED units are all in an ON state ("ON") and continuously illuminated.

In contrast, the RGB LED units 360 to 363 respectively correspond to light source units for the upper area, the upper middle area, the lower middle area, and the lower area of the screen. These light source units perform scan illumination from the upper portion to the lower portion of the screen in conformity with the LCD display unit 117. That is, after the image signal has been written, the operation to illuminate only the RGB LED units that correspond to each of the partition areas is executed in sequence within 1 frame period. Note that the power consumption in the illuminated state for the light source units of the RGB LED units is larger than that of the white light LED units. Thus, the power consumption can be restrained compared to the broad color gamut mode described in the first embodiment, because the illumination time of the white light LED units is long while the illumination time of the RGB LED units is short.

In the present embodiment, the white light LED units 103 to 106 are continuously illuminated at an amount of light equivalent to 100 cd/m$^2$. In addition, the total amount of light of the RGB LED units 360 to 363, when they are illuminated, and that of the white light LED units 103 to 106 is 200 cd/m$^2$. Thereby, a difference in brightness occurs between the portion at which only the white light LED units are illuminated and the portion at which the RGB LED units are illuminated in sequence. The portion having the high brightness of 200 cd/m$^2$ is scan illuminated using the pattern that is shown in FIG. 5, and to an observer, the portion having the low brightness of 100 cd/m$^2$ appears relatively gray. That is, due to the portion having the low brightness appearing gray, the contrast difference between the portion having a low brightness and the portion having the high brightness becomes small, and flicker becomes unnoticeable.

According to the second embodiment, among the RGB LED units and the white light LED units, one is continuously illuminated and the other is scan illuminated. Thereby, illumination control for a broad color gamut mode and illumination control for a low power consumption mode can be selected. In either mode, the effects that the flicker becomes unnoticeable and the video viewing characteristics of the display apparatus are improved are obtained. In addition, an energy saving effect can be obtained by switching to the low power consumption mode.

While the embodiments of the present invention have been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2011-062650 filed Mar. 22, 2011 and Japanese Patent Application No. 2011-271220 filed Dec. 12, 2011 which are hereby incorporated by reference herein their entirety.

What is claimed is:

1. A light source apparatus provided with a first light source unit comprising light emitting elements that provide white light illumination and a second light source unit comprising a first light emitting element, a second light emitting element, and a third light emitting element having properties that differ from those of the light emitting elements of the first light source unit and that provide white light illumination by color mixing, comprising: an illumination control unit configured to activate the first light source unit by repeatedly illuminating in sequence the light emitting elements of the first light source unit in each area of a plurality of partition areas of the first light source unit, while activating the second light source unit by continuously illuminating the light emitting elements of the second light source unit in one frame period, wherein each of the light emitting elements in a first partition area of the plurality of partition areas are illuminated and extinguished prior to illuminating each of the light emitting elements in a second partition area of the plurality of partition areas.

2. A backlight apparatus according to claim 1, comprising a mode switching unit configured to switch between a control mode in which the first light source unit is activated by scanning in sequence the light emitting elements of the first light source unit, the light emitting elements having been segmented into a plurality of partition areas, and the second light source unit is continuously activated and a control mode in which the second light source unit is activated by scanning in sequence the light emitting elements of the second light source unit, the light emitting elements having been segmented into a plurality of partition areas, and the first light source unit is continuously activated.

3. The light source apparatus according to claim 1, wherein the first light source unit comprises light emitting elements that individually provide white light illumination and the second light source unit comprises light emitting elements that provide white light illumination by color mixing.

4. A display apparatus comprising:

the light source apparatus according to claim 1; and a display unit configured to display an image using the light of the light source apparatus according to an image signal.

5. The display apparatus according to claim 4, wherein the illumination control unit is configured to repeat control in which light emitting elements in partition areas are activated in sequence from top to bottom in conformity to a display screen displayed by the display unit.

6. A control method for controlling a light source apparatus comprising a first light source unit comprising light emitting elements that provide white light illumination and a second light source unit comprising a first light emitting element, a second light emitting element, and a third light emitting element having properties that differ from those of the light emitting elements of the first light source unit and that provide white light illumination by color mixing, the method comprising: activating the first light source unit by repeatedly illuminating in sequence the light emitting elements of the first light source unit in each area of a plurality of partition areas of the first light source unit, while activating the second light source unit by continuously illuminating the light emitting elements of the second light source unit in one frame period, wherein each of the light emitting elements in a first partition area of the plurality of partition areas are illuminated and extinguished prior to illuminating each of the light emitting elements in a second partition area of the plurality of partition areas.

7. The control method according to claim 6, further comprising switching between a control mode in which the first light source unit is activated by repeatedly illuminating in sequence the light emitting elements of the first light source unit in each area of a plurality of partition areas in the first light source unit, and the second light source unit is activated by continuously illuminating the light emitting elements of the second light source unit and a control mode in which the second light source unit is activated by repeatedly illuminating in sequence the first light emitting element, the second light emitting element, and the third light emitting element of the second light source unit in each area of a plurality of partition areas in the second light source unit, and the first light source unit is activated by continuously illuminating the light emitting elements of the first light source unit.

8. The control method according to claim 6, wherein the first light source unit comprises light emitting elements that individually provide white light illumination and the second light source unit comprises light emitting elements that provide white light illumination by color mixing.

9. A control method for controlling a display apparatus comprising the light source apparatus according to claim 1, the method comprising:

displaying an image using the light of the light source apparatus according to an image signal.

10. The control method according to claim 9, wherein the illumination control unit is configured to repeat control in which light emitting elements in partition areas are activated in sequence from top to bottom in conformity to a display screen displayed in the displaying step.

11. The light source apparatus according to claim 1, wherein the light emitting element in one of the plurality of partition areas is extinguished prior to illuminating the light emitting element in next partition area.

12. The control method according to claim 6, wherein the light emitting element in one of the plurality of partition areas is extinguished prior to illuminating the light emitting element in next partition area.

13. The light source apparatus according to claim 1, wherein a total amount of light emitted by the first light source unit is greater than a total amount of light emitted by the second light source unit producing a brightness difference between the first light source unit and the second light source unit.

14. The control method according to claim 6, wherein a total amount of light emitted by the first light source unit is greater than a total amount of light emitted by the second light source unit producing a brightness difference between the first light source unit and the second light source unit.

15. A light source apparatus provided with a first light source unit comprising light emitting elements that provide white light illumination and a second light source unit comprising a first light emitting element, a second light emitting element, and a third light emitting element having properties that differ from those of the light emitting elements of the first light source unit and that provide white light illumination by color mixing, comprising: an illumination control unit configured to activate the first light source unit by repeatedly illuminating in sequence the light emitting elements of the first light source unit in each area of a plurality of partition areas of the first light source unit, while activating the second light source unit by continuously illuminating the light emitting elements of the second light source unit in one frame period, wherein the light emitting element in one of the plurality of partition areas is extinguished prior to illuminating the light emitting element in next partition area.

16. A control method for controlling a light source apparatus comprising a first light source unit comprising light emitting elements that provide white light illumination and a second light source unit comprising a first light emitting element, a second light emitting element, and a third light emitting element having properties that differ from those of the light emitting elements of the first light source unit and that provide white light illumination by color mixing, the method comprising: activating the first light source unit by repeatedly illuminating in sequence the light emitting elements of the first light source unit in each area of a plurality of partition areas of the first light source unit, while activating the second light source unit by continuously illuminating the light emitting elements of the second light source unit in one frame period, wherein the light emitting element in one of the plurality of partition areas is extinguished prior to illuminating the light emitting element in next partition area.

* * * * *